US007900456B2

(12) United States Patent
Mao

(10) Patent No.: US 7,900,456 B2
(45) Date of Patent: Mar. 8, 2011

(54) APPARATUS AND METHOD TO COMPENSATE FOR DIFFERENTIAL THERMAL GROWTH OF INJECTOR COMPONENTS

(75) Inventor: Chien-Pei Mao, Clive, IA (US)

(73) Assignee: Delavan Inc, West Des Moines, IA (US)

( * ) Notice: Subject to any disclaimer, the term of this patent is extended or adjusted under 35 U.S.C. 154(b) by 1002 days.

(21) Appl. No.: 11/784,658

(22) Filed: Apr. 9, 2007

(65) Prior Publication Data

US 2007/0283931 A1 Dec. 13, 2007

Related U.S. Application Data

(60) Provisional application No. 60/801,864, filed on May 19, 2006.

(51) Int. Cl.
*F02C 1/00* (2006.01)
*F02G 3/00* (2006.01)

(52) U.S. Cl. ..... 60/740; 60/799

(58) Field of Classification Search ..... 60/799, 60/800, 740, 741, 742, 747, 746, 734, 737; 123/456

See application file for complete search history.

(56) References Cited

U.S. PATENT DOCUMENTS

| | | | | | |
|---|---|---|---|---|---|
| 2,548,904 | A | * | 4/1951 | Neal et al. | 60/800 |
| 3,129,891 | A | | 4/1964 | Vdoviak | |
| 3,159,971 | A | * | 12/1964 | Moebius et al. | 60/740 |
| 3,662,959 | A | * | 5/1972 | Sample, Jr. | 239/533.2 |
| 4,258,544 | A | | 3/1981 | Gebhart et al. | |
| 4,409,791 | A | * | 10/1983 | Jourdain et al. | 60/240 |
| 4,649,950 | A | | 3/1987 | Bradley et al. | |
| 4,735,044 | A | * | 4/1988 | Richey et al. | 60/742 |
| 5,105,621 | A | * | 4/1992 | Simmons et al. | 60/303 |
| 5,423,178 | A | * | 6/1995 | Mains | 60/776 |
| 5,701,732 | A | * | 12/1997 | Nesbitt et al. | 60/776 |
| 6,276,141 | B1 | | 8/2001 | Pelletier | |
| 6,523,350 | B1 | * | 2/2003 | Mancini et al. | 60/740 |
| 6,672,066 | B2 | * | 1/2004 | Wrubel et al. | 60/740 |
| 6,755,024 | B1 | * | 6/2004 | Mao et al. | 60/776 |

FOREIGN PATENT DOCUMENTS

EP 1 369 644 A1 12/2003

OTHER PUBLICATIONS

UK Search Report dated Sep. 13, 2007.

* cited by examiner

*Primary Examiner* — William H Rodríguez
(74) *Attorney, Agent, or Firm* — Scott D. Wofsy; Edwards Angell Palmer & Dodge LLP

(57) ABSTRACT

A fuel injector for a gas turbine engine is disclosed that includes an injector body having a bore, a fitting at an inlet end of the injector body for receiving fuel, an atomizer at an outlet end of the injector body for delivering atomized fuel to a combustor of the gas turbine engine, a fuel tube disposed within the bore of the injector body for delivering fuel from the fitting to the atomizer, the fuel tube having an inlet end portion adjacent the fitting and an outlet end portion joined to the atomizer, and structure joined to the inlet end portion of the fuel tube to compensate for thermal growth of the injector body relative to the fuel tube during engine operation.

15 Claims, 8 Drawing Sheets

APPARATUS AND METHOD TO COMPENSATE FOR DIFFERENTIAL THERMAL GROWTH OF INJECTOR COMPONENTS

CROSS-REFERENCE TO RELATED APPLICATION

The subject application claims the benefit of priority to U.S. Provisional Patent Application Ser. No. 60/801,864 filed May 19, 2006, the disclosure of which is herein incorporated by reference in its entirety.

BACKGROUND OF THE INVENTION

1. Field of the Invention

The subject invention is directed to an apparatus and method to compensate for differential growth of fuel injector components due to thermal expansion, and more particularly, to an apparatus and method for accommodating thermal growth of a fuel injector body relative to a fuel delivery tube disposed within the fuel injector body during engine operation.

2. Description of Related Art

Fuel injectors are important components of gas turbine engines and they play a critical role in determining engine performance. A typical fuel injector includes an external support body having an inlet fitting at one end for receiving fuel and an atomizer nozzle at the other end for issuing atomized fuel into the combustor of a gas turbine engine. The inlet fitting is in fluid communication with the atomizer nozzle by way of an internal fuel delivery tube, as shown for example in FIG. 1.

During engine operation, the external support body of the fuel injector is surrounded by high-temperature compressor air, while the internal fuel delivery tube carries liquid fuel to the atomizer nozzle at a much lower temperature than the compressor air. Because of the temperature difference, the injector support body experiences thermal expansion differently than the fuel delivery tube. More specifically, the injector support body will experience thermal growth to a greater extent than the fuel delivery tube.

In some fuel injectors, the fuel delivery tubes are rigidly connected to the injector support body at one end adjacent the inlet fitting and to the atomizer nozzle on the other end, using a welded or brazed joint. As a result of the differential thermal expansion between the injector support and the fuel delivery tube, high stress concentrations can develop at the joint locations. These stress concentrations can lead to the formation and propagation of cracks, eventually leading to fuel leaks, resulting in injector failures.

Efforts have been made to mitigate these problems. For example, for many years it was well known to design injectors with fuel tubes having helical or coiled sections to accommodate differential thermal growth between the injector support and the fuel tube. Indeed, the prior art is replete with patents disclosing such coiled fuel tubes, as shown for example in U.S. Pat. No. 3,129,891 to Vdoviak; U.S. Pat. No. 4,258,544 to Gebhart et al.; U.S. Pat. No. 4,649,950 to Bradley et al.; and U.S. Pat. No. 6,276,141 to Pelletier. Those skilled in the art will readily appreciate that there is a significant cost associated with the formation of a helically coiled fuel tube, particularly in instances wherein dual concentric fuel tubes are employed.

The subject invention provides a cost-effective solution to mitigate the problems associated with differential thermal expansion of injector components, and an improvement over prior art devices employing helical fuel tubes. More particularly, the subject invention provides an apparatus and method to compensate for thermal growth of the injector support body relative to the fuel delivery tube during engine operation.

SUMMARY OF THE INVENTION

The subject invention is directed to a new and useful fuel injector for a gas turbine engine that includes, among other things, an injector body including a longitudinal bore, an inlet fitting at an inlet end of the injector body for receiving fuel, an atomization nozzle at an outlet end of the injector body for delivering atomized fuel to a combustor of the gas turbine engine, a fuel tube disposed within the bore of the injector body for delivering fuel from the inlet fitting to the atomization nozzle, and means accommodated within an inlet end of the bore and joined to an inlet end portion of the fuel tube to compensate for thermal growth of the injector body relative to the fuel tube during engine operation.

In an embodiment of the subject invention, the means to compensate for thermal growth of the injector body relative to the fuel tube includes a flexible metallic diaphragm of circular configuration having a centrally located aperture joined to the inlet end portion of the fuel tube and an outer periphery joined to an interior wall of the bore of the injector body. In one instance, the flexible metallic diaphragm has plural concentric corrugations, and in another instance, the flexible metallic diaphragm is generally flat in configuration. It is also envisioned that the flexible metallic diaphragm may have a pre-stressed or pre-loaded state prior to thermal expansion.

In another embodiment of the subject invention, the means to compensate for thermal growth of the injector body relative to the fuel tube is disposed between axially spaced apart upper and lower sections of the fuel tube, wherein the upper section of the fuel tube is joined to a fuel passage of the inlet fitting and the lower section of the fuel tube is joined to the atomizer.

In one instance, the means to compensate for thermal growth of the injector body relative to the fuel tube includes a generally C-shaped flexible metallic channel defining an interior fuel flow path and having conjoined upper and lower legs disposed between the axially spaced apart upper and lower sections of the fuel tube. Here, the upper leg of the channel has an inlet aperture joined to the upper section of the fuel tube and the lower leg of the channel has an outlet aperture joined to the lower section of the fuel tube.

In another instance, the means to compensate for thermal growth of the injector body relative to the fuel tube includes upper and lower conjoined flexible metallic diaphragms disposed between the axially spaced apart upper and lower sections of the fuel tube. Here, the upper diaphragm is joined to the upper section of the fuel tube and the lower diaphragm is joined to the lower section of the fuel tube.

The subject invention is also directed to a method to compensate for thermal growth in a fuel injector for a gas turbine engine, which includes the steps of providing an injector body having a bore extending therethrough, and having an inlet fitting associated with an inlet end of the injector body for receiving fuel, an atomizer associated with an outlet end of the injector body for delivering atomized fuel to a combustor of the gas turbine engine, and a fuel tube disposed within the bore of the injector body for delivering fuel from the inlet fitting to the atomizer. The method further includes the steps of forming a fixed connection between an outlet end of the fuel tube and the atomizer, and forming a flexible connection between an inlet end portion of the fuel tube and either an interior wall of the bore proximate the fitting or the inlet fitting itself to compensate for thermal growth of the injector body relative to the fuel tube during engine operation.

These and other features of the apparatus and method of the subject invention will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the fuel injectors of the subject invention without undue experimentation, preferred embodiments thereof will be described in detail hereinbelow with reference to certain figures, wherein.

ENABLING DESCRIPTION OF PREFERRED EMBODIMENTS

Figure 1:
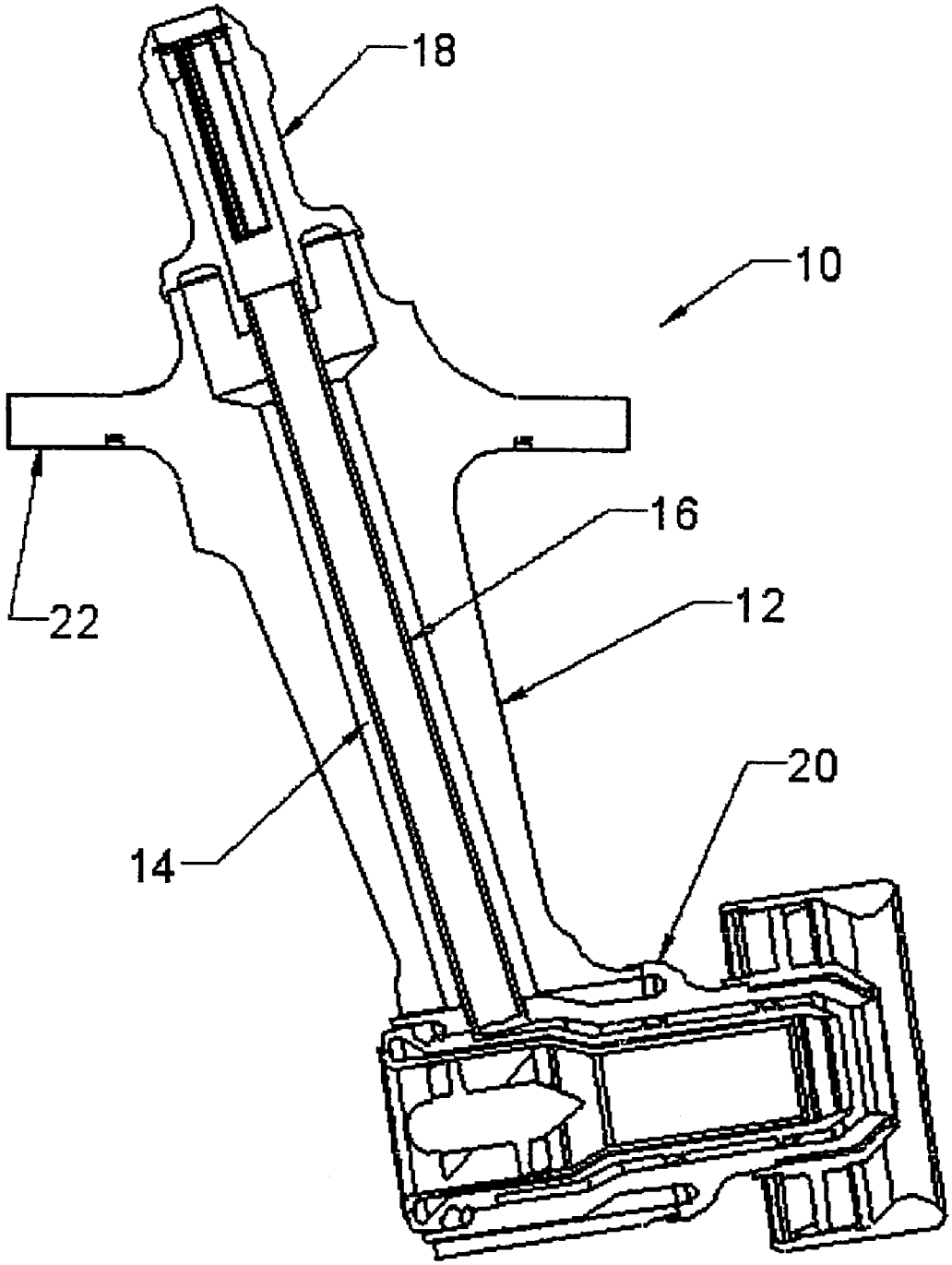
FIG. 1 (Prior Art)
FIG. 1 is a side elevational view, in cross-section, of a prior art fuel injector having an injector body with a longitudinal bore supporting a fuel delivery tube, wherein the fuel delivery tube has an inlet end joined to a fitting at an inlet end of the injector body and an outlet end joined to an atomizer at an outlet end of the injector body.

Referring now to the drawings, there is illustrated in FIG. 1 a prior art fuel injector 10 for a gas turbine engine. Fuel injector 10 has an injector body 12 with a longitudinal bore 14 extending therethrough supporting a fuel delivery tube 16. The fuel delivery tube 16 has an inlet end fixedly joined by way of brazing or welding to a fitting 18 at an inlet end of the injector body 12 and an outlet end fixedly joined by way of brazing or welding to an atomizer nozzle 20 at an outlet end of the injector body 12.

The injector body 12 includes a support flange 22 for mounting the injector 10 to the outer casing of a gas turbine engine combustor (not shown). Once mounted, the fitting 18 is located exterior to the outer casing and the atomizer support body 12 is located on the interior of the engine casing, with the atomizer nozzle 20 issuing atomized fuel into the combustor of a gas turbine engine. During engine operation, the injector support body 12 is surrounded by high temperature compressor air flowing through the engine casing, while the fuel delivery tube 16 located within the injector support body 12 is maintained at a relatively lower temperature, because it carries lower temperature fuel to the atomizer nozzle 20. Consequently, injector support 12 undergoes thermal expansion differently than the fuel delivery tube 16.

Figure 2:
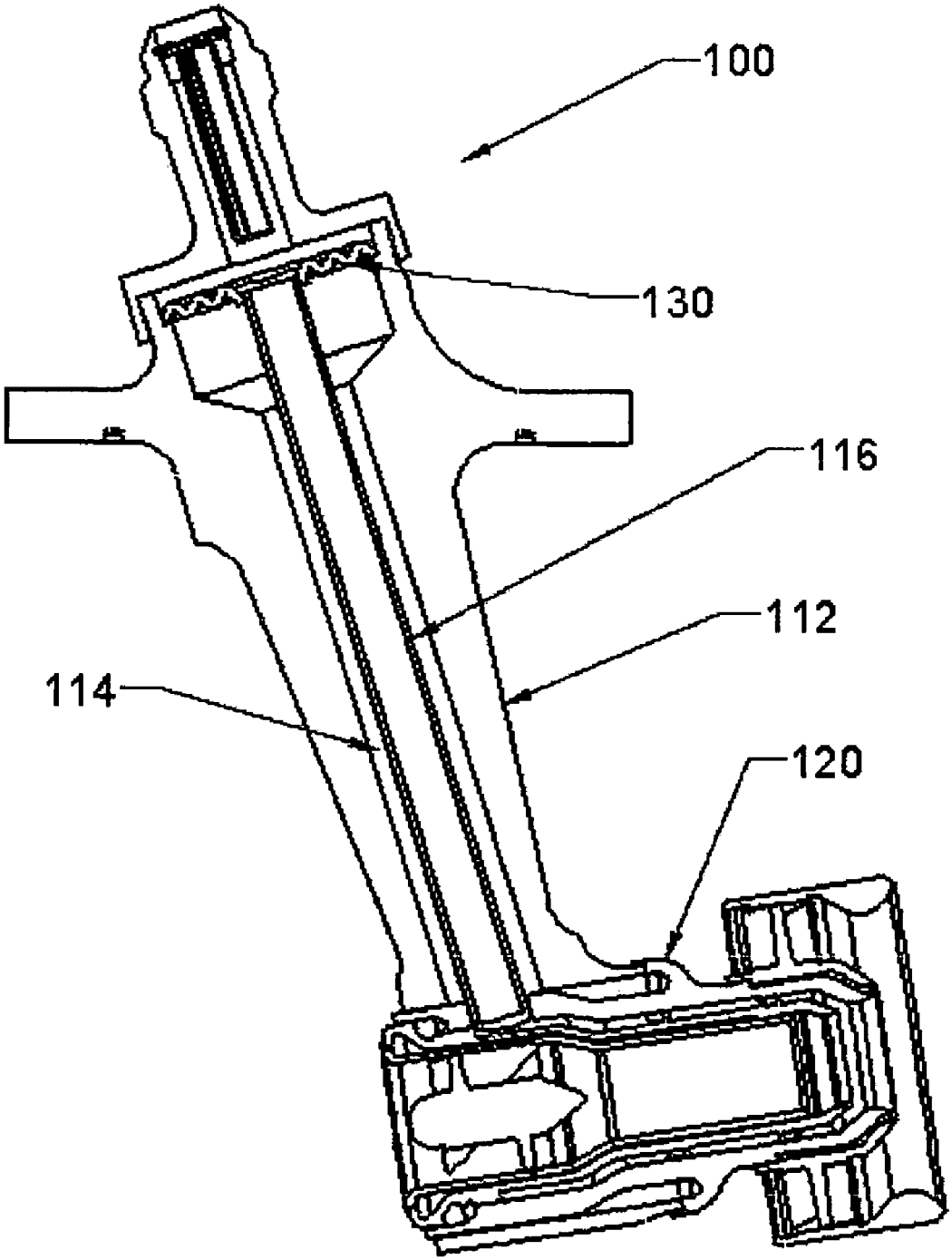
FIG. 2 is a side elevational view, in cross-section, of a fuel injector constructed in accordance with a preferred embodiment of the subject invention, wherein a corrugated metallic diaphragm is joined to an inlet end portion of the fuel delivery tube and to an interior wall of the longitudinal bore formed in the injector body.

Referring now to FIG. 2, there is illustrated a fuel injector constructed in accordance with a preferred embodiment of the subject invention and designated generally by reference numeral 100. Fuel injector 100 includes a corrugated flexible metallic diaphragm 130 that is joined to the inlet end portion of the fuel delivery tube 116 and to an interior wall of the longitudinal bore 114 formed in the injector body 112. The outlet end portion of fuel delivery tube 116 is brazed or otherwise rigidly connected to the atomizer nozzle 120.

Figure 3:
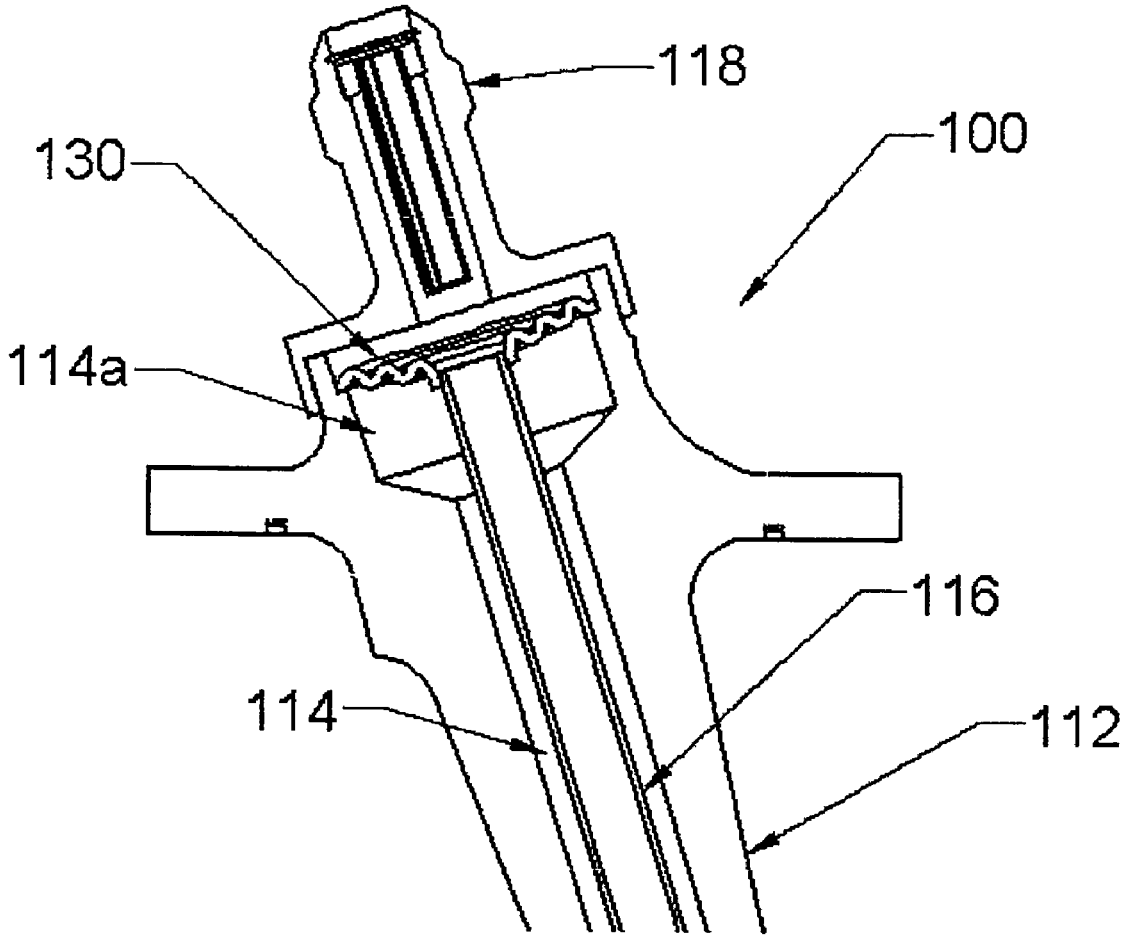
FIG. 3 is an enlarged side elevational view, in cross-section, of the inlet end of the fuel injector of FIG. 2, illustrating the shape of the corrugated flexible metallic diaphragm when the injector body undergoes thermal expansion relative to the fuel delivery tube during engine operation.

As best seen in FIG. 3, during engine operation, when the injector body 112 is surrounded by high temperature compressor air and the fuel tube 116 carries lower temperature fuel, the corrugated flexible metallic diaphragm 130 compensates for the thermal expansion of the injector support body 112 relative to the fuel delivery tube 116 by expanding downwardly. The depicted expanded configuration of diaphragm 130 and the extent to which the diaphragm is shown to expand are merely illustrative of the concepts embodied herein, and should not be construed in any way to limit the scope of the subject invention.

Figure 4:
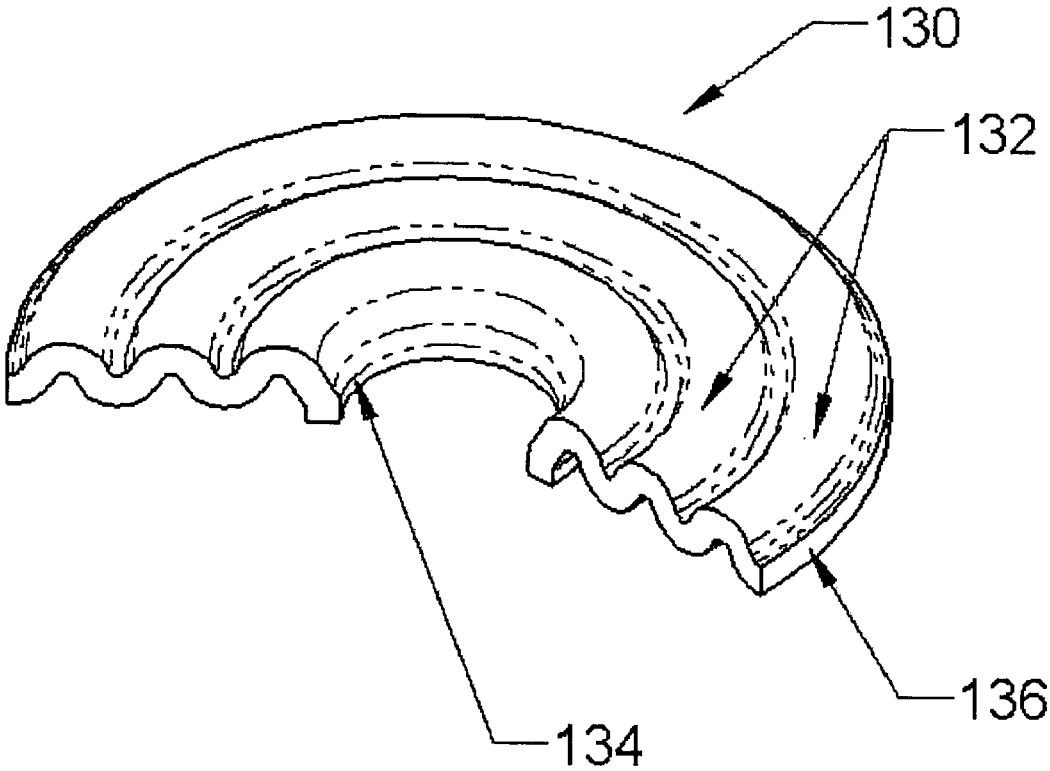
FIG. 4 is an enlarged perspective view, in cross-section, of the corrugated metallic diaphragm shown in FIGS. 2 and 3, illustrating the concentric corrugations thereof.

As illustrated in FIG. 4, the corrugated metallic diaphragm 130 is generally circular in configuration with a plurality of concentric corrugations 132. A mounting aperture 134 is provided at the center of diaphragm 130 for receiving the inlet end portion of fuel delivery tube 116. Diaphragm 130 also has an outer peripheral edge 136 to facilitate a rigid connection between the diaphragm and the interior wall of bore 114. More particularly, diaphragm 130 is accommodated within an enlarged cavity 114*a* of longitudinal bore 114, which is located at the inlet end of injector body 112 proximate inlet fitting 118. Although the diaphragm 130 is illustrated and described as having a generally circular configuration, those skilled in the art will readily appreciate that the shape of the diaphragm can and will vary depending upon the cross-sectional shape of the cavity or bore within which the diaphragm is mounted. Furthermore, the number and geometry of the corrugations can vary to achieve a particular degree of flexibility.

Figure 5:
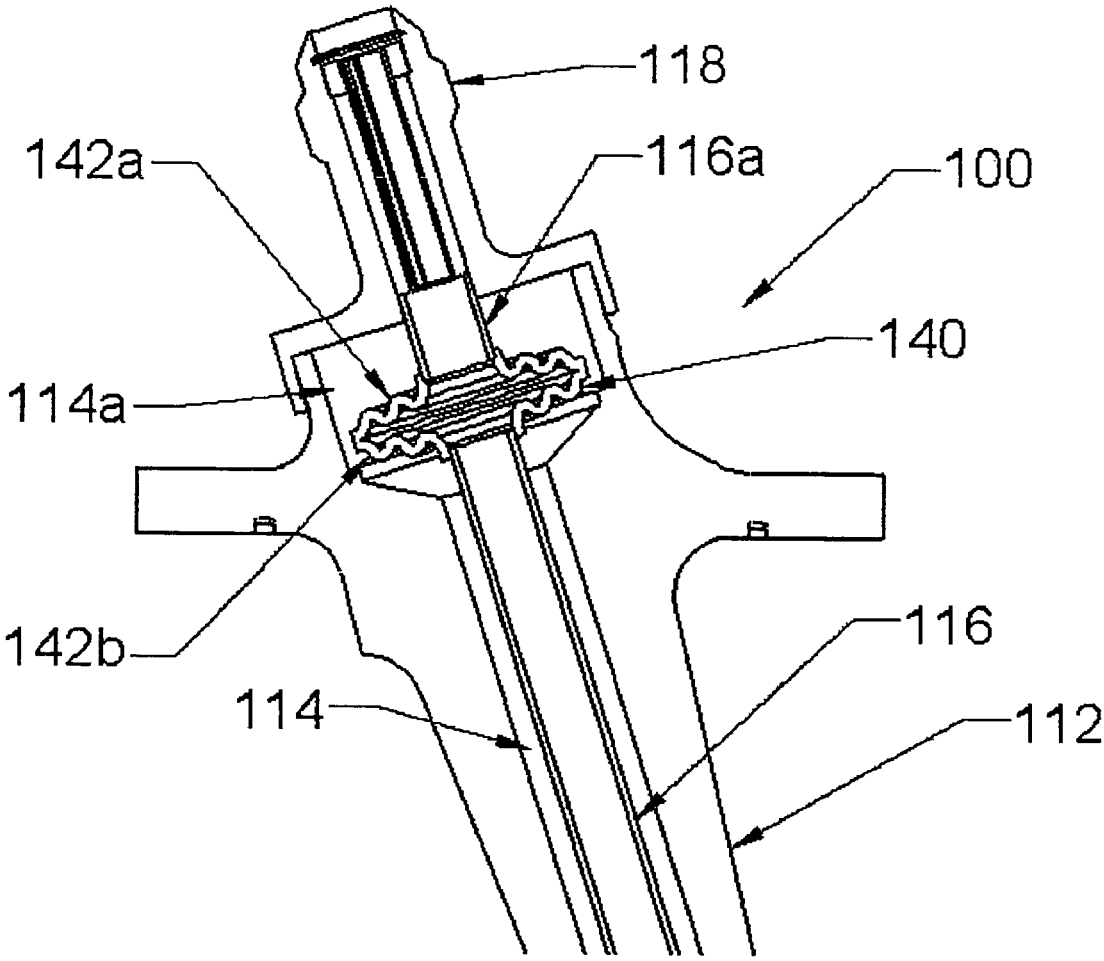
FIG. 5 is an enlarged side elevational view, in cross-section, of an inlet end of another fuel injector constructed in accordance with a preferred embodiment of the subject invention, wherein two conjoined corrugated flexible metallic diaphragms are associated with an inlet end portion of the fuel delivery tube.

Referring to FIG. 5, in another embodiment of the fuel injector 100, a dual diaphragm structure 140 is operatively associated with the inlet end portion of fuel delivery tube 116. Dual diaphragm 140 is preferably formed from two conjoined corrugated flexible metallic diaphragms, including an upper diaphragm 142*a* and a lower diaphragm 142*b*. The upper diaphragm 142*a* is brazed or otherwise rigidly connected to an inlet section 116*a* of fuel delivery tube 116, while the lower diaphragm 142*b* is brazed or otherwise rigidly connected to the main section of fuel delivery tube 116. In this embodiment of the invention, the inlet end section 116*a* of fuel delivery tube 116 is in turn brazed or otherwise rigidly connected to the fuel passage of inlet fitting 118. Here, there is no rigid connection between the dual diaphragm 140 and the interior wall of the enlarged cavity 114*a* of longitudinal bore 114. Those skilled in the art will readily appreciate that the dual diaphragm 140 could be formed as a one-piece, unitary structure, rather than from two conjoined diaphragms, as described above.

Figure 6:
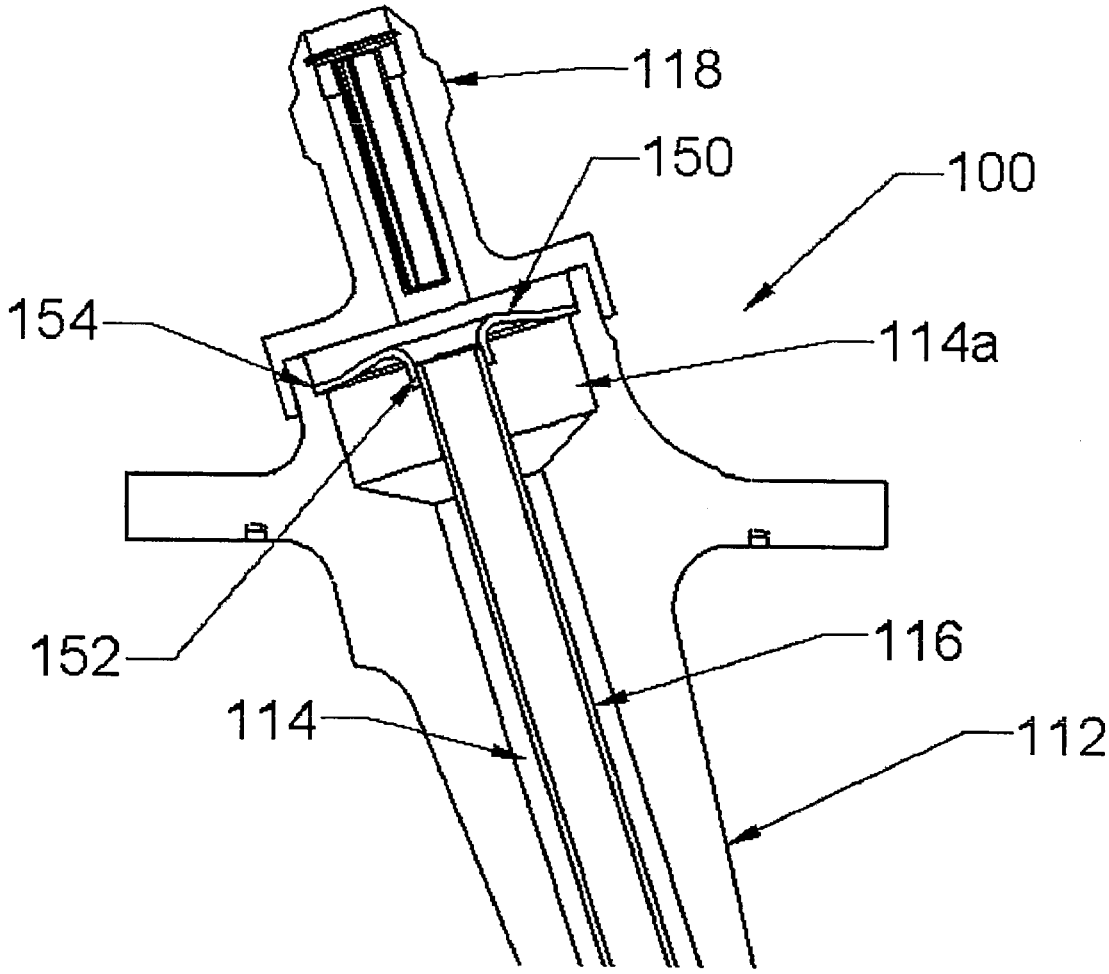
FIG. 6 is an enlarged side elevational view, in cross-section, of an inlet end of still another fuel injector constructed in accordance with a preferred embodiment of the subject invention, wherein a flat flexible metallic diaphragm is joined to an inlet end portion of the fuel delivery tube and to an interior wall of the longitudinal bore formed in the injector body.
Figure 7:
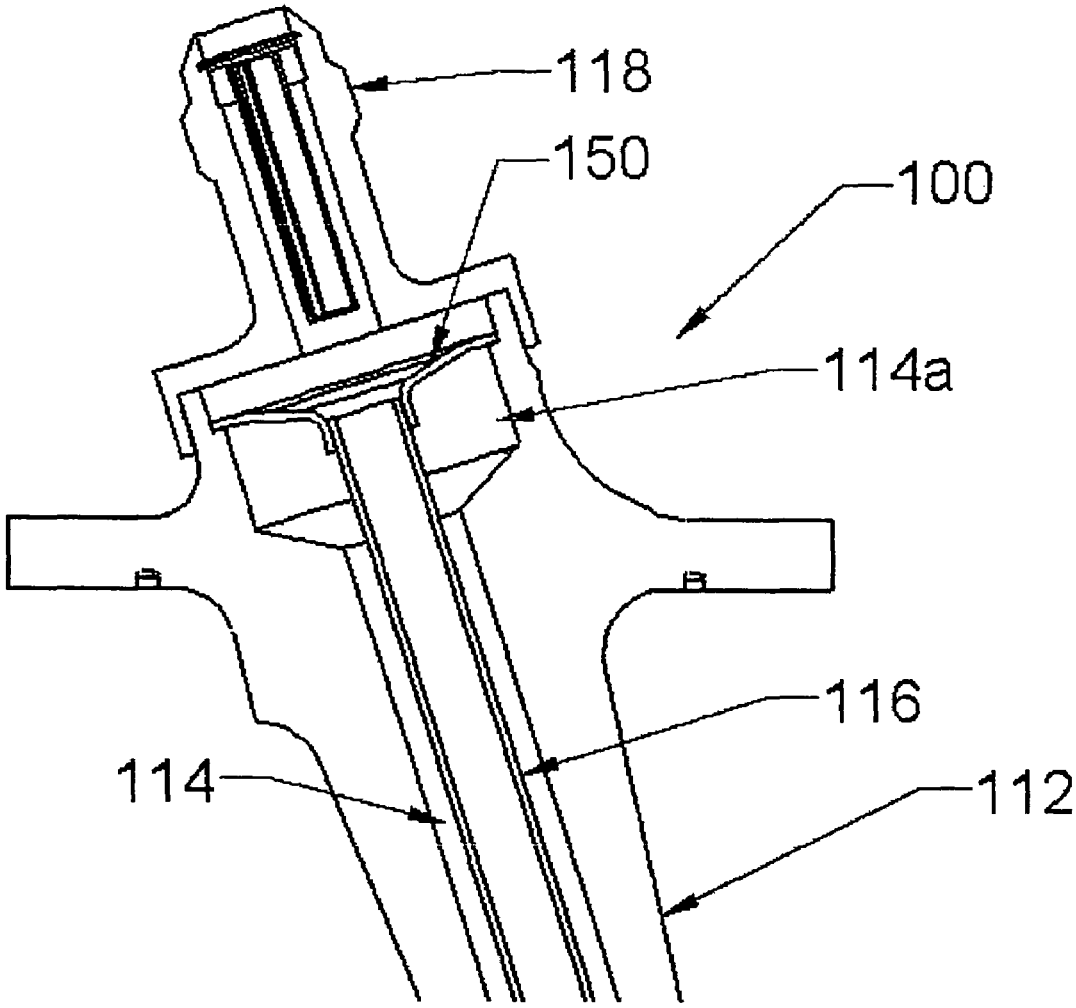
FIG. 7 is an enlarged side elevational view, in cross-section, of the inlet end of the fuel injector of FIG. 6, illustrating the shape of the flat flexible metallic diaphragm when the injector body undergoes thermal expansion relative to the fuel tube during engine operation.

Referring now to FIGS. 6 and 7, in another embodiment of fuel injector 100, a flat flexible metallic diaphragm 150 is joined to an inlet end portion of the fuel delivery tube 116 and to an interior wall of the longitudinal bore 114 formed in the injector body 112. More particularly, a mounting aperture 152 is provided at the center of diaphragm 150 for receiving the inlet end portion of fuel delivery tube 116, and diaphragm 150 has an outer peripheral edge 154 to facilitate a rigid connection between the diaphragm 150 and the interior wall of bore 114*a*. When the engine employing nozzle 100 is not in operation, the flat flexible metallic diaphragm 150 is preferably disposed in a pre-stressed or pre-loaded state, which is shown for example in FIG. 6. To compensate for the thermal expansion of the injector support body 112 relative to the fuel delivery tube 116 during engine operation, the flat pre-loaded diaphragm moves to an expanded state, shown for example in FIG. 7. The depicted pre-stressed and expanded configurations of diaphragm 150 and the extent to which diaphragm 150 is shown to expand are merely illustrative of the concepts embodied herein, and should not be construed in any way to limit the scope of the subject invention.

Figure 8:
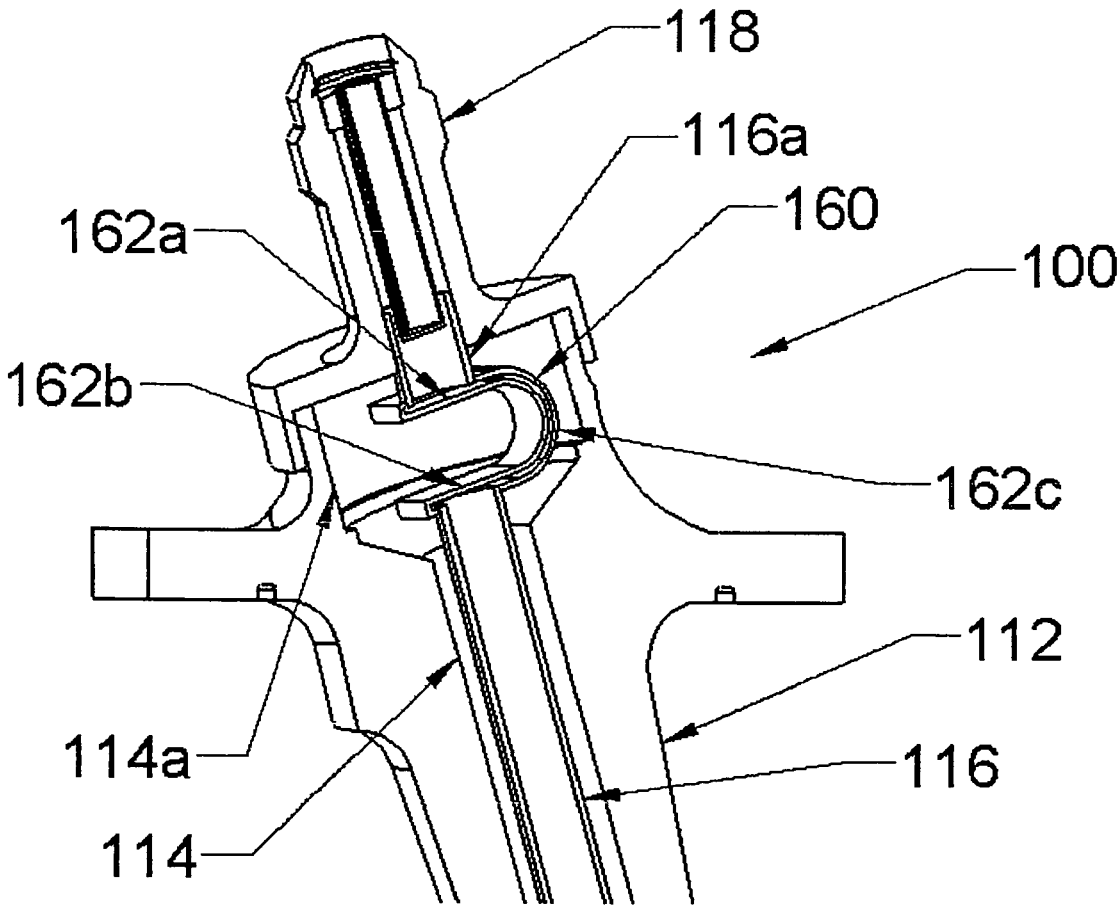
FIG. 8 is an enlarged side elevational view, in cross-section, of an inlet end of yet another fuel injector constructed in accordance with a preferred embodiment of the subject invention, wherein a generally C-shaped flexible metallic channel is associated with an inlet end portion of the fuel tube.

Referring now to FIG. 8, in yet another embodiment of the subject invention, a bent or generally C-shaped flexible metallic channel structure 160 is associated with an inlet end portion of fuel tube 116*a* to compensate for the thermal expansion of the injector support body 112 relative to the fuel delivery tube 116 during engine operation. Channel structure 160 has an internal fuel path communicating with fuel delivery tube 116, and it includes a straight upper leg portion 162*a*, a straight lower leg portion 162*b* and a curved connective portion 162*c* between the upper and lower leg portions 162*a*, 162*b*. The upper leg portion 162*a* is brazed or otherwise rigidly connected to an inlet section 116*a* of fuel delivery tube 116, while the lower leg portion 162*b* is brazed or otherwise rigidly connected to the main section of fuel delivery tube 116. In this embodiment of the invention, the inlet end section 116*a* of fuel delivery tube 116 is in turn brazed or otherwise rigidly connected to the fuel passage of inlet fitting 118. Here, there is no rigid connection between the channel structure 160 and the interior wall of the enlarged cavity 114*a* of the longitudinal bore 114 of injector 100.

It is envisioned and well within the scope of the subject disclosure that the concepts and embodiments described herein could be employed in a two-stage or dual-fuel injector that has two concentric fuel delivery tubes extending through a bore in an injector support body. In a two-stage fuel injector, for example, a primary inner fuel tube delivers fuel to a pilot atomizer of the injector nozzle and a secondary outer fuel tube delivers fuel to a radially outer main atomizer of the injector nozzle. It is envisioned that the inlet end portion of the outer fuel tube would have a first flexible metallic diaphragm associated therewith and the inlet end portion of the inner fuel tube would extend beyond the inlet end portion of the outer fuel tube and have a second flexible metallic diaphragm associated therewith. The two diaphragms would be axially spaced apart from one another and rigidly connected to the interior wall of the longitudinal bore of the injector body at axially spaced apart locations.

While the apparatus and method of subject invention have been shown and described with reference to preferred embodiments, those skilled in the art will readily appreciate that changes and/or modifications may be made thereto without departing from the spirit and cope of the subject invention.

What is claimed is:

1. A fuel injector for a gas turbine engine comprising:

a) an injector body including a bore;

b) a fitting at an inlet end of the injector body for receiving fuel;

c) an atomizer at an outlet end of the injector body for delivering atomized fuel to a combustor of the gas turbine engine;

d) a fuel tube disposed within the bore of the injector body for delivering fuel from the fitting to the atomizer, the fuel tube having an inlet end portion adjacent the fitting and an outlet end portion joined to the atomizer; and e) a flexible metallic diaphragm joined to the inlet end portion of the fuel tube to compensate for thermal growth of the injector body relative to the fuel tube during engine operation.

2. A fuel injector as recited in claim 1, wherein the flexible metallic diaphragm is of circular configuration having a centrally located aperture joined to the inlet end portion of the fuel tube and an outer periphery joined to an interior wall of the bore of the injector body.

3. A fuel injector as recited in claim 2, wherein the flexible metallic diaphragm is accommodated in an enlarged recess at an inlet end of the bore proximate the fitting.

4. A fuel injector as recited in claim 1, wherein the flexible metallic diaphragm has plural concentric corrugations.

5. A fuel injector as recited in claim 1, wherein the flexible metallic diaphragm is generally flat.

6. A fuel injector as recited in claim 5, wherein the flexible metallic diaphragm has a pre-stressed state.

7. A fuel injector as recited in claim 1, wherein the flexible metallic diaphragm is disposed between axially spaced apart upper and lower sections of the inlet end portion of the fuel tube, wherein the upper section of the inlet end portion of the fuel tube is joined to a fuel passage of the fitting.

8. A fuel injector as recited in claim 7, wherein the flexible metallic diaphragm includes upper and lower conjoined flexible metallic diaphragms disposed between the axially spaced apart upper and lower sections of the inlet end portion of the fuel tube, wherein the upper diaphragm is joined to the upper section of the inlet end portion of the fuel tube and the lower diaphragm is joined to the lower section of the inlet end portion of the fuel tube.

9. A fuel injector for a gas turbine engine comprising:

a) an injector body defining an inlet end and an outlet end, and having a bore extending therethrough, the bore including an enlarged cavity adjacent the inlet end of the injector body;

b) a fitting associated with the inlet end of the injector body and having a fuel inlet passage for receiving fuel;

c) an atomizer associated with an outlet end of the injector body for delivering atomized fuel to a combustor of the gas turbine engine;

d) a fuel tube disposed within the bore of the injector body for delivering fuel from the fitting to the atomizer, the fuel tube having an inlet end portion adjacent the fitting and an outlet end portion joined to the atomizer; and e) means joined to the inlet end portion of the fuel tube and to an interior wall of the enlarged cavity of the bore to compensate for thermal growth of the injector body relative to the fuel tube during engine operation.

10. A fuel injector as recited in claim 9, wherein the means to compensate for thermal growth of the injector body relative to the fuel tube includes a flexible metallic diaphragm of circular configuration having a centrally located aperture joined to the inlet end portion of the fuel tube and an outer periphery joined to an interior wall of the enlarged cavity of the bore of the injector body.

11. A fuel injector as recited in claim 10, wherein the flexible metallic diaphragm has plural concentric corrugations.

12. A fuel injector as recited in claim 10, wherein the flexible metallic diaphragm is generally flat.

13. A fuel injector as recited in claim 12, wherein the flexible metallic diaphragm has a pre-stressed state.

14. A fuel injector for a gas turbine engine comprising:

a) an injector body defining an inlet end and an outlet end, and having a bore extending therethrough, the bore including an enlarged cavity adjacent the inlet end of the injector body;

b) a fitting associated with the inlet end of the injector body and having a fuel inlet passage for receiving fuel;

c) an atomizer associated with an outlet end of the injector body for delivering atomized fuel to a combustor of the gas turbine engine;

d) a fuel tube disposed within the bore of the injector body for delivering fuel from the fitting to the atomizer, the fuel tube having an upper end portion joined to the fitting and a lower end portion joined to the atomizer; and e) means joining the upper end portion of the fuel tube to the lower end portion of the fuel tube to compensate for thermal growth of the injector body relative to the fuel tube during engine operation, wherein the means includes a generally C-shaped flexible metallic channel defining an interior fuel flow path and having conjoined upper and lower legs, wherein the upper leg of the channel has an inlet aperture joined to the upper end portion of the fuel tube and the lower leg of the channel has an outlet aperture joined to the lower end portion of the fuel tube.

15. A method to compensate for thermal growth in a fuel injector for a gas turbine engine comprising the steps of:

a) providing an injector body having a bore extending therethrough, and having an inlet fitting associated with an inlet end of the injector body for receiving fuel, an atomizer associated with an outlet end of the injector body for delivering atomized fuel to a combustor of the gas turbine engine, and a fuel tube disposed within the bore of the injector body for delivering fuel from the inlet fitting to the atomizer;

b) forming a fixed connection between an outlet end of the fuel tube and the atomizer; and c) forming a flexible connection between an inlet end portion of the fuel tube and an interior wall of the bore proximate the fitting to compensate for thermal growth of the injector body relative to the fuel tube during engine operation.

* * * * *